United States Patent [19]

Brown et al.

[11] Patent Number: 4,845,593

[45] Date of Patent: Jul. 4, 1989

[54] SAFETY SYSTEM FOR AN ELECTRICAL OUTPUT PANEL ASSEMBLY

[75] Inventors: Clifford C. Brown; William M. Hanks, both of Cincinnati, Ohio

[73] Assignee: Cam-Lok, Inc., Cincinnati, Ohio

[21] Appl. No.: 203,708

[22] Filed: Jun. 7, 1988

[51] Int. Cl.[4] ..... H01R 13/629

[52] U.S. Cl. ..... 361/192; 361/179; 361/339; 439/305; 439/133

[58] Field of Search ..... 361/187, 191, 192, 337, 361/339; 439/133, 101, 102, 39, 304, 305, 333, 677

[56] References Cited

U.S. PATENT DOCUMENTS

| | | | |
|---|---|---|---|
| 3,131,012 | 4/1964 | Healy | 439/305 |
| 3,350,675 | 10/1967 | Misenick et al. | 439/305 |
| 3,629,791 | 12/1971 | Normann | 439/677 |
| 3,670,287 | 6/1972 | Keto | 439/305 |
| 4,071,722 | 1/1978 | Hart | 361/339 X |
| 4,767,347 | 8/1988 | Kamp et al. | 439/133 |

*Primary Examiner*—A. D. Pellinen
*Assistant Examiner*—H. L. Williams
*Attorney, Agent, or Firm*—Frost & Jacobs

[57] ABSTRACT

A safety system for an electrical panel assembly providing receptacles for use with cable connectors. The connectors and receptacles are of the known type having single contacts which lock together when the connector is mated with its receptacle and rotated a partial turn. Polarizing devices are provided in association with each receptacle and connector to assure proper mating. The panel assembly is provided with mechanical interlocking devices determining the order in which the connectors are connected to and disconnected from their receptacles to assure that ground makes first and breaks last. The safety system comprises an AC to DC converter/voltage regulator capable of converting 120 volts to 600 volts AC or DC to 12 volts and 115 volts DC. The converter/regulator has a pair of inputs connected to the contacts of any two power receptacles or the contacts of a neutral receptacle and a power receptacle of the panel. The 115 volt outputs of the converter/regulator are connected to first and second solenoids associated with the first and last receptacles, respectively. The solenoids have plungers which, when the panel receptacles have voltage applied thereto, shift from a retracted to an extended position wherein the plunger of the first solenoid precludes connection and locking of the ground connector with the first receptacle and the plunger of the second solenoid precludes disconnection of the power connector from the last receptacle, thus preventing powered connections or disconnections from the panel. The safety system also contemplates an alarm if the connnector for the last receptacle is not rotated and locked.

12 Claims, 5 Drawing Sheets

SAFETY SYSTEM FOR AN ELECTRICAL OUTPUT PANEL ASSEMBLY

TECHNICAL FIELD

The invention relates to a safety system for an electrical output panel assembly having a plurality of receptacals for use with cable connectors, polarizing means assuring that each connector is matable only with its respective receptacle, and locking means determining the order in which the connectors are connected and disconnected from their respective receptacles to assure that ground makes first and brakes last. More particularly, the invention relates to a safety system for such a panel which precludes connection and disconnection of the cable connectors with their respective receptacles, so long as the panel has voltage applied to the receptacles.

BACKGROUND ART

Prior art workers have devised numerous types of electrical output panels having two or more receptacles for use with single conductor cable connectors. While their use is by no means so limited, such panel assemblies are employed in lighting and sound applications for theatrical and concert productions, circuses, television studios, movie studios and the like. It will be understood that lighting equipment and sound equipment require a multitude of connections. Single conductor connectors are preferred because cable for multiple conductor connectors is generally characterized by large diameter, considerable weight, and is difficult to maneuver and transport.

Prior art workers have recognized that when dealing with single conductor connectors, it is important that each individual connector be connected only with its intended receptacle. Color coding and various types of indicia are helpful in this respect, but they do not preclude error. As a result, prior art workers have devised polarizing means which make it physically impossible to mate a connector with any receptacle other than its intended receptacle.

It is further important, both to protect the equipment and as a safety factor, to connect and disconnect a series of connectors to and from the panel assembly in a particular order. For example, where a ground is used, it is generally desirable that the ground makes first and brakes last. As a result, prior art workers have devised panel assemblies provided with interlocking devices requiring the connectors to be mated with their respective receptacles in a given order and disconnected therefrom in the reverse of that order. Examples of panel assemblies provided with polarizing means and interlocking devices are taught in copending application Ser. No. 07/067,239, filed June 25, 1987 in the names of David C. Kamp and Albert P. Newman, now U.S. Pat. No. 4,767,347 and entitled ELECTRICAL PANEL ASSEMBLY. The teachings of this application are incorporated herein by reference.

When a panel assembly of the type under discussion is used as an output panel, there is a third important factor to consider to prevent damage to equipment being connected to the panel assembly, the panel assembly itself, and for safety reasons. When the cable connectors are being connected to the panel assembly, or are being disconnected therefrom, the power source to which the panel is connected should be turned off. Prior art workers have approached this problem by providing, as optional equipment, a limit switch in association with the last receptacle and a magnetic circuit breaker. While this works well, the elements required are extremely expensive and this type of safety system adds considerably to the cost of the equipment.

The present invention is based upon the discovery that a safety system to prevent powered connection or disconnection can be provided quite inexpensively. The safety system of the present invention is simple in construction, inexpensive to install, and foolproof. The safety system will prevent release of the panel interlock elements by the ground connector so long as the panel has voltage applied to its receptacles. Further, the safety system will prevent disconnection of the last power connector so long as there is voltage applied to the panel receptacles.

As will be apparent to one skilled in the art, the teachings of the present invention, with appropriate modifications, can be applied to any multiple receptacle output panel assembly having mechanical interlocking elements determining the order of connection and disconnection of the cable connectors to and from the panel. For purposes of an exemplary showing, the present invention will be taught in its application to the preferred panel embodiment of the above-mentioned copending application.

DISCLOSURE OF THE INVENTION

According to the invention there is provided a safety system for an electrical panel assembly having a plurality of receptacles for use with single contact cable connectors. The connectors and receptacles are of the well-known type having single contacts which lock together when the connector is mated with its receptacle and rotated a partial revolution with respect thereto.

Polarizing devices are provided in association with each receptacle and each connector, to assure that each connector is matable only with its respective receptacle. The panel assembly may have from two to five receptacles and is provided with mechanical interlocking devices which determine the order in which the connectors are mated to and disconnected from their respective receptacles, to assure that ground makes first and brakes last.

The safety system comprises an AC to DC converter/voltage regulator capable of converting 120 volts to 600 volts AC or DC to 12 volts DC and 115 volts DC.

Regardless of whether the panel has two, three, four or five receptacles, the first receptacle will always be ground and the last receptacle will always be power. The converter/regulator has a pair of inputs, one of which is operatively connected to the contact of the neutral receptacle, and the second of which is operatively connected to the contact of any power receptacle. In a three phase panel, the converter/regulator inputs can be connected to the neutral receptacle contact (if present) and any one of the three power receptacle contacts, or they can be connected to any two of the three power receptacle contacts. The converter/regulator has a pair of outputs, connected to a pair of first and second solenoids associated with the first and last receptacles, respectively.

Each of the first and second solenoids has an armature or plunger which normally occupies a retracted position when the solenoid is not energized and which shifts to an extended position when the solenoid is energized. The first solenoid is so positioned with respect to the first receptacle that its plunger, when in its extended position, precludes rotation and locking of a connector in the first receptacle. As a consequence, all of the remaining receptacles are disabled by means of the mechanical interlocking elements. The second solenoid is so positioned with respect to the last receptacle that, when energized, its plunger occupies a position precluding rotation and unlocking of a cable connector from the last receptacle. As a result, none of the cable connectors can be disconnected from the panel, by virtue of the mechanical interlocking elements, when the second solenoid is energized. As a result of this arrangement, so long as there is voltage applied to the panel receptacles, the first and second solenoids will be energized and connection of the cable connectors with their respective receptacles cannot be accomplished. Similarly, if the cable connectors are already connected to their respective receptacles, they cannot be disconnected therefrom so long as there is voltage applied to the panel receptacles. Thus, powered connection and disconnection are precluded.

It would be possible to connect the appropriate cable connector with the last receptacle, while failing to rotate and lock it. Should this occur, the second solenoid plunger would be ineffective and powered disconnection could be accomplished. To prevent this, the invention contemplates the provision of an appropriate alarm which will be energized so long as there is voltage applied to the panel receptacles and the cable connector attached to the last receptacle is not rotated and locked. Rotation and locking of the cable connector of the last receptacle will disconnect the alarm. Once the cable connector for the last receptacle has been rotated and locked, the second solenoid will preclude its unlocking and removal, so long as there is voltage applied to the panel receptacles.

DETAILED DESCRIPTION OF THE INVENTION

As indicated above, for purposes of an exemplary showing the teachings of the present invention will be illustrated as applied to the preferred embodiment of electrical panel taught in the above-noted copending application. For purposes of clarity, in all of the figures, like parts have been given like index numerals.

Panels of the type to which the present invention is directed may be provided with from two to five openings giving access to from two to five receptacles. A two receptacle panel is provided with a first neutral/-ground receptacle and a second single phase AC or DC receptacle. A three receptacle panel has a first ground receptacle, a second neutral receptacle, and a third single phase AC or DC receptacle. A four receptacle panel is a three phase AC panel having a first ground receptacle, a second phase-one receptacle, a third phase-two receptacle and a fourth phase-three receptacle. Finally, a five receptacle panel is found in a three phase AC system having a first ground receptacle, a second neutral receptacle, a third phase-one receptacle, a fourth phase-two receptacle, and a fifth phase-three receptacle. It will be noted that in all four of these instances, the first receptacle (normally the lefthandmost receptacle) is connected to ground, while the last receptacle (normally the righthandmost receptacle) is connected to power. Again, for purposes of an exemplary showing, the panel of FIG. 1 is illustrated as a five receptacle panel for a three phase system wherein, from left to right, the receptacles constitute ground, neutral, phase-one, phase-two and phase-three.

Figure 1:
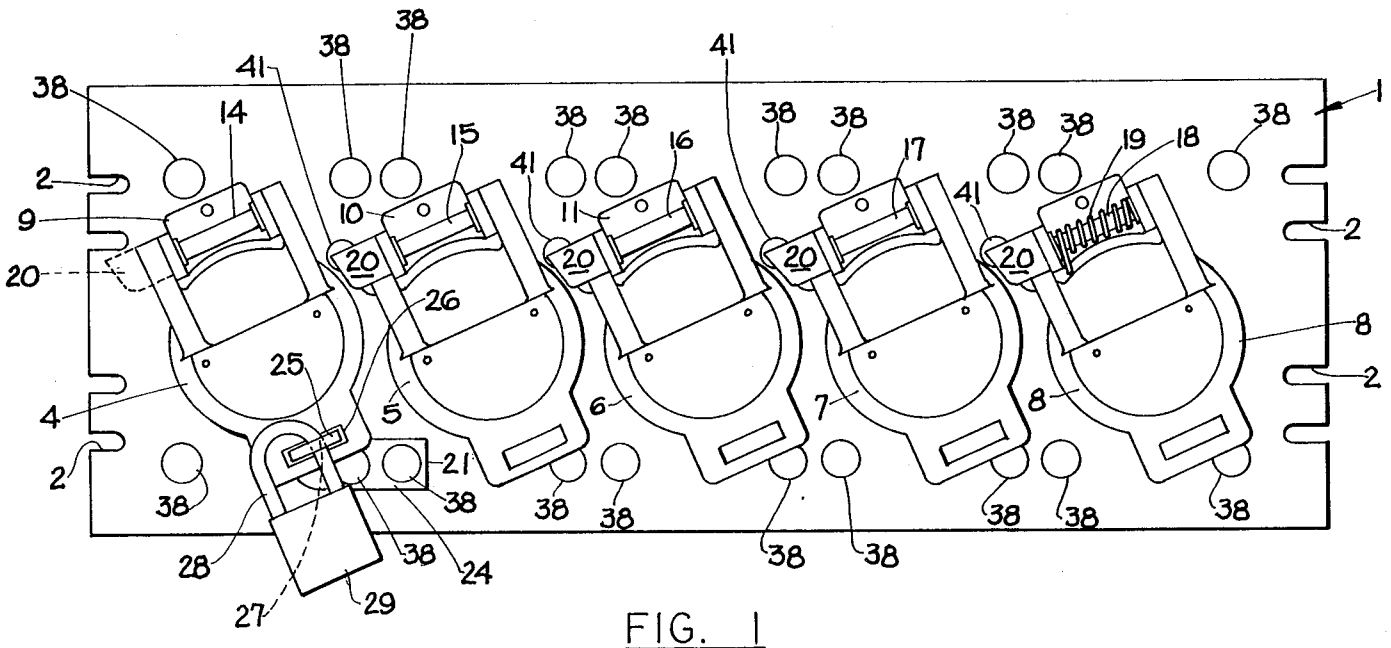
FIG. 1 PRIOR ART
FIG. 1 is an elevational view of an exemplary prior art to which the present invention is applicable.

In FIG. 1, the panel is generally indicated at 1. The panel 1 comprises a planar member provided with slots 2 at its ends, for the receipt of fastening means (not shown) by which it may be affixed to any desired structure, rack, console or surface.

Panel 1 is provided with five circular openings, not shown in FIG. 1. One of the circular openings is illustrated at 3 in FIG. 2. These openings are adapted to receive the connector-polarizing shell assemblies of the ground cable, the neutral cable, and the first, second and third line cables, respectively, as will be apparent hereinafter.

As is shown in FIG. 1, covers 4–8 are mounted over each of the openings by means of hinge brackets 9–13. The covers 4–8 are pivotally attached to their respective hinge brackets 9–13 by means of identical hinge pins 14–18.

Each of the covers 4-8 may be color coded and may carry indicia indicating which connector is to be inserted in each of the perforations located behind the covers. The connectors, themselves, or their polarizing shells, or both, may be similarly color coded, as is known in the art. Each of covers 4–8 are biased to their closed position. This is accomplished by torsion spring means mounted on hinge pins 14–18. For purposes of clarity, only one such spring means is illustrated at 19 in FIG. 1, mounted on hinge pin 18. It will be understood that each of hinge pins 14∫17 will similarly be provided with such a torsion spring. Each of covers 5–8 is provided with a lateral locking flange 20, the purpose of which will be apparent hereinafter. There is no need for such a locking flange on cover 4. The locking flange of cover 4 has been shown in broken lines, indicating that it may be eliminated, if desired.

Preferably, cover 4 is provided with a locking bracket 21. Locking bracket 21 has a base portion 24 affixed to panel 1 and an upstanding portion 25 which extends through a slot 26 in cover 4, when cover 4 is in its closed position. The upstanding portion 25 of locking bracket 21 has a perforation 27 therethrough for receipt of the shackle 28 of a padlock 29. The purpose of locking bracket 21 will be explained hereinafter.

Figure 2:
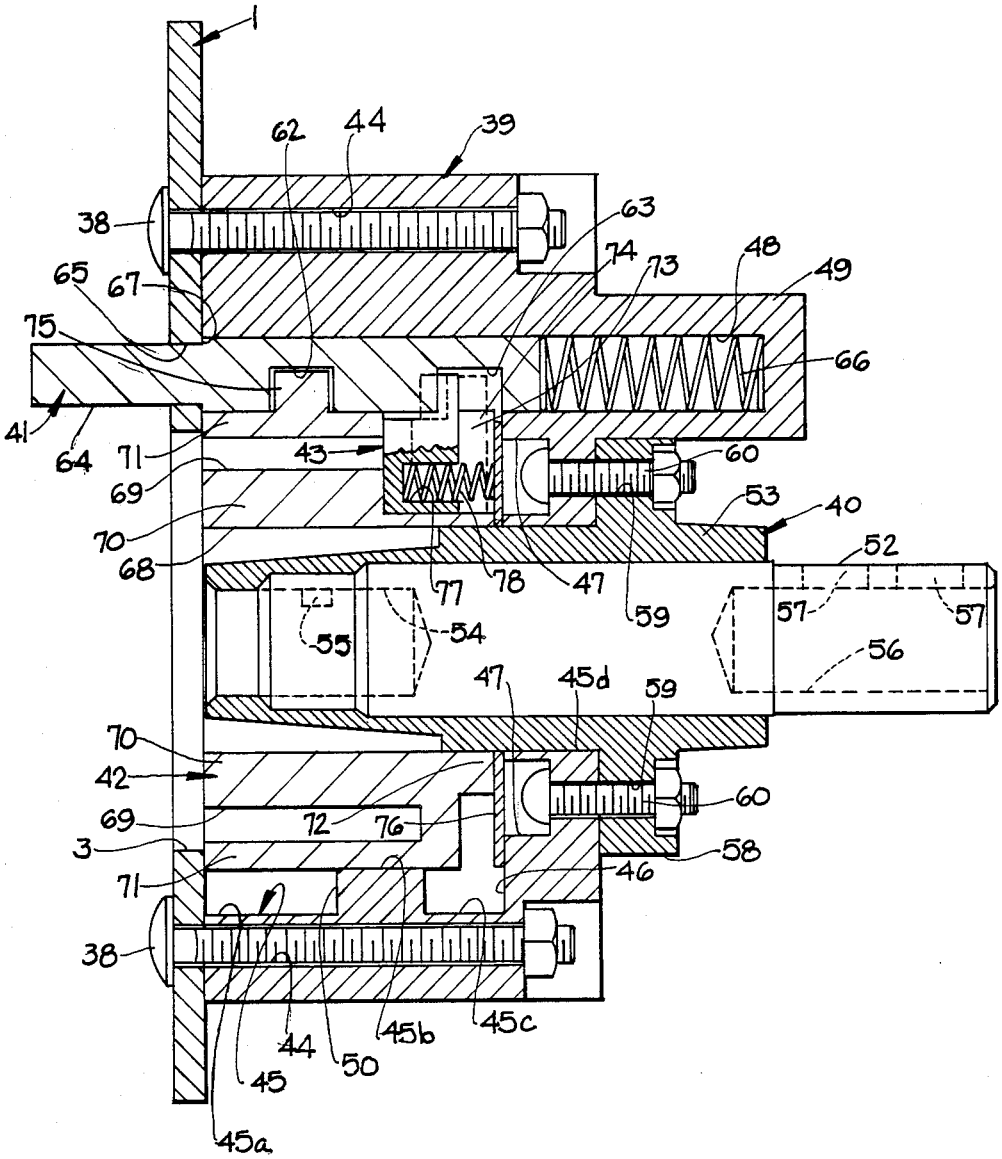
FIG. 2 PRIOR ART
FIG. 2 is a cross sectional view of a typical receptacle of the panel of FIG. 1.

A plurality of bolts 38 extend through panel 1 and are used to attach the five receptacles to the rear surface of the panel. This is also shown in FIG. 2. It will be noted from FIG. 1 that selected ones of the bolts 38 are utilized to affix the locking bracket 21 to panel 1.

Figure 5:
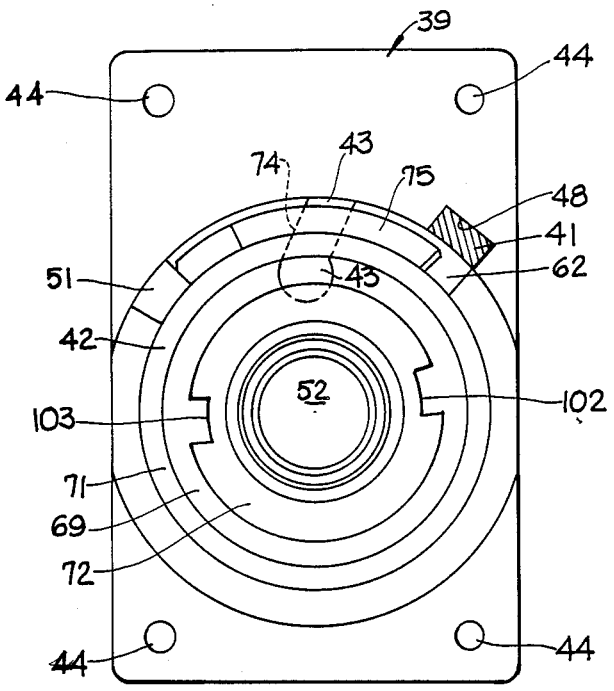
FIG. 5 PRIOR ART
FIGS. 5 and 6 are simplified elevational views of the receptacle of FIG. 2 illustrating the maximum counterclockwise rotative position and the maximum clockwise position of the rotating ring within the receptacle housing, respectively.
Figure 6:
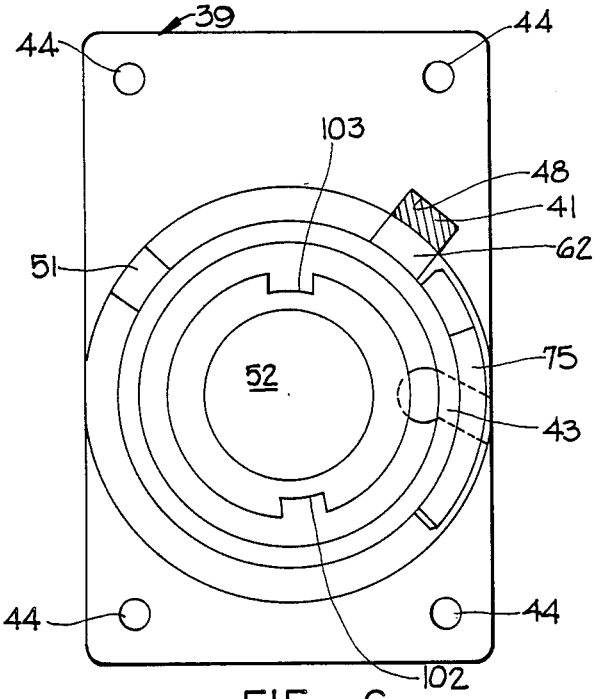
FIG. 6 PRIOR ART

Reference is now made to FIGS. 2, 5 and 6. These figures illustrate an exemplary receptacle housing, one of which is mounted on the rear surface of panel 1 behind each of the openings therein. For purposes of an exemplary showing, the receptacle housing, generally indicated at 39, will be considered to be that receptacle housing mounted behind panel opening 3 and cover 4, for the ground receptacle. Since the receptacle housings behind each of the panel openings are identical, a description of housing 39 can serve as a description of all of the receptacle housings. In FIG. 2, the panel 1 is shown together with its opening 3, but for purposes of clarity, the cover 4 has been deleted.

Receptacle housing 39 is shown in FIG. 2 as containing a female receptacle, generally indicated at 40, a locking pin generally indicated at 41, a female rotating ring generally indicated at 42, and a locking latch generally indicated at 43. Each of these elements will be described in their turn.

Receptacle housing 39 comprises a substantially rectangular structure preferably molded of insulative plastic material or the like. Adjacent its four corners, the receptacle housing is provided with perforations 44 for receipt of bolts 38.

Receptacle housing 39 has a circular bore extending therethrough from its forward face to its rearward face. The bore is generally indicated at 45 and is made up of bore portions of differing diameters. The first bore portion 45*a* is located nearest the forward surface of the housing and has a diameter slightly greater than the width of the housing, as is clearly shown in FIGS. 5 and 6. The next bore portion 45*b* is of a diameter slightly less than the width of the receptacle housing. The third bore portion 45*c* is of the same diameter as the first portion 45*a*. The final portion 45*d*, nearest the rear surface of the receptacle housing 39, has the smallest diameter of any of the bore portions.

Bore portions 45*c* and 45*d* define an annular shoulder 46 therebetween. A series of four perforations (two of which are shown at 47) is evenly spaced about bore portion 45*d* and extending through shoulder 46 to the rear surface of the receptacle housing 39.

A bore of rectangular cross section is shown at 48. It will be noted that the rectangular bore portion 48 intersects bore portions 45*a*, 45*b* and 45*c*. A portion of the rectangular bore 48 continues into an extension 49, protruding from the rear surface of receptacle housing 39.

The main bore portions 45*a* and 45*b* define therebetween a shoulder 50. The shoulder 50 has a stop lug 51 formed thereon and extending into bore portion 45*a*. The stop lug 51 is clearly shown in FIGS. 5 and 6. The purpose of stop 51 will be apparent hereinafter.

The female receptacle 40 is substantially conventional and comprises a female contact 52 surrounded by an insulative body 53. The female contact may be of the type taught in U.S. Pat. No. Re. 25,506. The female contact has at its forward end a central bore or socket 54 adapted to receive the male contact. The socket 54 has an inwardly projecting pin 55 adapted to cooperate with an L-shaped groove in the male contact to lock the contacts in mated condition, when the male contact is rotated a partial turn, as will be described. At its rearward end, the female contact may be connected to a busbar, a cable, or the like For purposes of an exemplary showing, the female contact 52 is illustrated as having a cable receiving socket 56. The cable (not shown) is maintained in the socket by a pair of set screws 57.

The insulative body 53 is provided with a rectangular flange 58. The rectangular flange 58 has near its corners four identical bores (two of which are shown at 59). The female receptacle 40 is affixed to receptacle housing 39. To this end, the forward portion of receptacle 40 is inserted through receptacle housing bore portion 45*d* and extends forwardly through receptacle housing bore portions 45*c*, 45*b* and 45*a*, nearly to the rear surface of panel 1. The receptacle flange 58 is affixed to the rear surface of receptacle housing 39 by bolts 60 passing through receptacle housing perforations 37 and receptacle flange perforations 59.

Locking pin 41 comprises a bar-like body 61 having a rectangular cross section. The body 61 has a pair of notches 62 and 63 formed therein. At its forward end, the body 61 terminates in a cylindrical nose portion 64. The nose portion 64 is preferably an integral one-piece part of body 61.

As is shown in FIG. 2, the locking pin 41 is slideably mounted in the rectangular bore 48 of receptacle housing 39. The nose portion 64 of locking pin 41 extends slideably through a perforation 65 in panel 1. In FIG. 2, the locking pin 41 is shown in its forwardmost position, to which it is constantly biased by compression spring 66. The forwardmost position of locking pin 41 is determined by the abutment of the rear surface of panel 1 by the shoulder 67 formed between the locking pin nose portion 64 and the locking pin body portion 61.

The female rotating ring 42 comprises a generally cylindrical member having an axial bore 68. The wall of the female rotating ring 41 is also provided with an annular groove 69. The central bore 68 and the annular groove 69 define an inner annular wall 70 and an outer annular wall 71.

The rear surface of the female rotating ring has a narrow annular wall 72 surrounding the central bore 68. The narrow annular wall 72 has an extension 73 which extends to the periphery of the female rotating ring. The extension 73 has a socket 74 formed therein, which socket extends partway into annular walls 70 and 71 and intersects the annular groove 69.

Between socket 74 and the forward end of the female rotating ring, its outer wall 71 carries an integral, arcuate lug 75.

FIGS. 2, 5 and 6 illustrate the female rotating ring 42 mounted in position within receptacle housing 39. It will be noted in FIG. 2 that a thin annular washer 76 of insulative material is mounted in the receptacle housing 39 and is located adjacent the shoulder 46, covering perforations 47 therein. The female rotating ring 42 is rotatively mounted on the forward portion of the receptacle body 53, the forward portion extending into the central bore 68 of the female rotating ring 42. The annular wall 72 on the rearward surface of the female rotating ring 42 abuts the washer 76. The forward edge of the outer wall 71 of the female rotating ring 42 abuts the rear surface of panel 1, so that the female rotating ring is rotatively and captively mounted within the receptacle housing 39. It will be noted in FIG. 2 that the annular groove 69 of the female rotating ring is exposed through panel opening 3. The arcuate lug 75 of the female rotating ring is receivable within the forward notch 62 of locking pin 41. Finally, the female rotating ring is further stabilized by bore portion 45*b* of receptacle housing 39. The diameter of receptacle housing bore portion 45b and the exterior diameter of the female rotating ring are such as to permit rotation of the female rotating ring relative to the bore portion 45b. The female rotating ring lends itself well to being molded as an integral, one-piece part, of insulative plastic material or the like.

The locking latch 43 is located in the female rotating ring socket 74 and comprises an L-shaped member, a portions 43A of which extends beyond the periphery of the female rotating ring outer wall 71. The locking latch 43 is provided with a bore 77 containing a compression spring 78. The locking latch 43 is slideably mounted in the female rotating ring socket 74 and is constantly urged forwardly in the socket 74 by compression spring 78.

It will be noted from FIG. 2 that the locking latch 43, under the urging of compression spring 78, normally occupies a position in socket 74 such that the upstanding portion 43A of the locking latch extends somewhat forwardly and out of alignment with the rearward notch 63 of locking pin 41. However, the locking latch 43 is shiftable rearwardly in socket 74, against the action of compression spring 78, to a position (shown in broken lines) wherein its upstanding portion 43A is in alignment with the notch 63 of locking pin 41.

The purpose and function of the female receptacle 40, locking pin 41, female rotating ring 42 and locking latch 43 will be apparent hereinafter.

Figure 4:
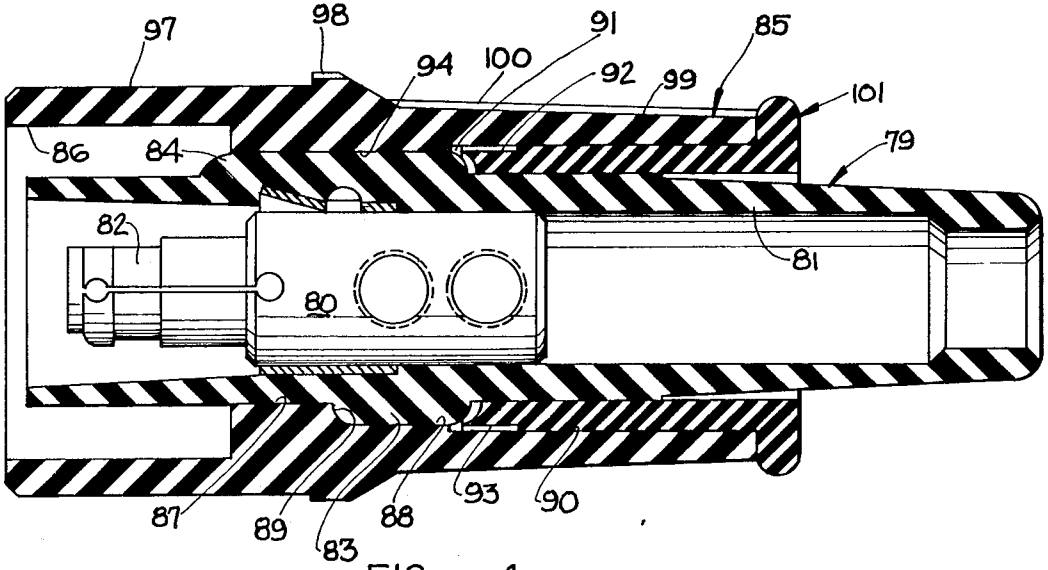
FIG. 4 PRIOR ART
FIG. 4 is a cross sectional view taken along section line 4—4 of FIG. 3.
Figure 3:
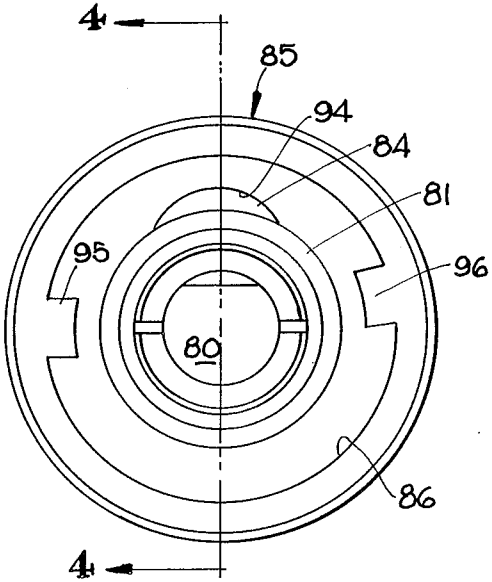
FIG. 3 PRIOR ART
FIG. 3 is a front elevational view of a cable connector and a polarizing shell for use with the panel of FIG. 1.

Reference is now made to FIGS. 3 and 4. In these figures, a male connector, generally indicated at 79, is shown comprising a male contact 80 and an insulative housing 81 therefore. The male connector 79 is conventional and can be of the type taught in the above-noted U.S. Pat. No. Re. 25,506. The male contact 80 is provided with a L-shaped peripheral channel 82 adapted to coact with the pin 55 (see FIG. 2) of the female contact, such that the channel and pin cooperate to lock the contacts together when the male contact is inserted in the female contact and then rotated approximately 90 degrees. Such locking of the male and female contacts upon engagement and rotation is well-known in the art. The insulative connector housing 81 has an annular raised portion 83 provided with a forward extension 84.

The polarizing shell for the male connector 79 is generally indicated at 85. Polarizing shell 85 comprises a generally cylindrical member having an axial bore. The axial bore has a large diameter portion 86 near the forward end of the polarizing shell. Bore portion 86 is followed by bore portion 87 of lesser diameter. Bore portion 87 is followed bore portion 88 having a greater diameter than bore portion 87 and a lesser diameter than bore portion 86. An annular shoulder 89 is formed between bore portions 87 and 88. Finally, a rearward bore portion 90 has a diameter slightly greater than bore portion 88, but again less than that of bore portion 86. Bore portions 89 and 90 form an annular shoulder 91. A pair of small, diametrically opposed keys 92 and 93 extend rearwardly from shoulder 91. It will further be noted that bore portion 87 is relieved as at 94. The bore portion 86 has formed on its inner surface a pair of polarizing lugs 95 and 96.

The forward exterior surface 97 of polarizing shell 85 is of uniform cylindrical configuration. The surface 97 is followed by a surface 98 of slightly greater diameter, the surface 98 tapering rearwardly and inwardly to the rearward exterior surface 99 of the polarizing shell 85, which surface tapers gently rearwardly and inwardly as shown in FIG. 4. The rearward exterior surface 99 of polarizing shell 85 may be provided with a plurality of longitudinal ribs 100 (see FIG. 4) by which the polarizing shell-connector assembly may be more easily manually grasped and rotated.

The polarizing shell 85 is shown in FIG. 4 mounted on connector 79. Connector 79 is inserted into the polarizing shell 85 from the rear and is shifted forwardly therein until the forward end of the annular raised portion 83 of the connector housing abuts the arcuate internal shoulder 89 of the polarizing shell. This abutment precludes further forward movement of the connector with respect to the polarizing shell. The relief 94 in the polarizing shell accommodates the forward extension 84 of the connector housing 81. The forward extension 84 and the relief 94 cooperate to prevent relative rotation of the connector 79 and the polarizing shell 85. The connector 79 is locked in its fully seated position within the polarizing shell 85 by a back ring assembly, generally indicated at 101 in FIG. 4. Back ring 101 is made up of two mating halves and is insertable between rearward end of polarizing shell 85 and the rearward end of connector 79. The back ring assembly abuts shoulder 91 and has keys formed thereon to engage keyways 92 and 93. The back ring assembly 101 is attached to polarizing shell 85 by self-tapping screws (not shown). Once in place, it will be apparent from FIG. 4 that the polarizing shell 85 is effectively fixed to connector 79 by the back ring assembly. Reference is now made to FIG. 5. As is clearly shown in FIG 5, the outer periphery of the inner wall 72 of female rotating ring 42 is provided with a pair of polarizing slots 102 and 103 adapted to cooperate with the polarizing lugs 95 and 96, respectively, of polarizing shell 85. It will be understood by one skilled in the art that each receptacle will be provided with its own female rotating ring. Each female rotating ring will be provided with polarizing slots similar to slots 102 and 103, but differently positioned. A polarizing shell of the polarizing shell-connector assembly for each receptacle will have polarizing lugs similar to lugs 95 and 96 so positioned as to cooperate only with the polarizing ring slots of the polarizing ring of its particular receptacle. As a consequence of this, each connector can be mated only with its specific receptacle.

The prior art panel assembly having been described in detail, its operation can now be set forth. As indicated above, FIG. 2 illustrates the first receptacle mounted behind the first or left hand most cover 4 of FIG. 1. FIG. 2 can also be considered to represent the receptacle housing and its appurtenances behind each of the additional covers 5-8.

FIG. 2 illustrates the receptacle housing 39 and its appertinences in their normal condition in the absence of a connector. Locking pin 41 is in its fully extended position and is locked therein by engagement of the female rotating ring lug 75 in the locking pin notch 62. The forwardmost end of the locking pin 41 is illustrated in FIG. 1 as underlying the lateral locking flange 20 of cover 5. With the locking pin 41 extended beneath the flange 20 of cover 5, the cover 5 is precluded from being opened. It will be understood that this will be true of all of covers 6, 7 and 8, as well, each of their locking flanges 20 being engaged by locking pins 41. It will be noted from FIG. 1 that there is no locking pin for cover 4, covering the ground receptacle. For this reason, the flange 20 of cover 4 can be eliminated, if desired. It will further be understood that in the absence of connectors, only cover 4 can be opened and access can be had only to the ground receptacle.

Referring to FIG. 5, this simplified front elevational view of receptacle housing 39 illustrates the female rotating ring 42 mounted therein. The female rotating ring 42 carries locking latch 43. Locking pin 41 is shown in its rectangular bore 48.

In FIG. 5, the female rotating ring 42 is shown in its maximum counterclockwise rotative position. This is determined by abutment of the female rotating ring lug 75 against the receptacle housing stop 51. It will be apparent from FIG. 5 that the maximum clockwise rotative position of the female rotating ring 42, in the absence of a connector, will be determined by abutment of locking latch 43 against the side of locking pin 41, since the locking latch 43 normally occupies a position wherein it is out of alignment with the locking pin notch 63, as shown in FIG. 2.

When the ground connector 79 and its polarizing shell 85 are inserted through the panel opening 3, the male contact 80 will be received within the socket 54 of the female contact 52. The forward end of connector housing 81 will be received within the confines of the inner annular wall 72 of the female rotating ring 42. Finally, the forward end of polarizing shell 85 will be received within the annular groove 69 of the female rotating ring 42, between its inner and outer walls 70 and 71. The polarizing lugs 95 and 96 of polarizing shell 85 are received within polarizing slots 102 and 103, respectively, of the female rotating ring 42. It will be remembered that the female rotating ring socket 73 contains locking latch 43 and intersects the annular groove 69 of the female rotating ring. Therefore, when the connector-polarizing shell assembly 79–85 is fully seated within the female rotating ring 42, the forward portion of the polarizing shell 85 will engage the locking latch 43 and shift it rearwardly against the action of its compression spring 78 to a position wherein it is aligned with the notch 63 in locking pin 41.

With locking latch 43 no longer precluding further clockwise rotation of female rotating ring 42, the connector-polarizing shell assembly 79–85 and the female rotating ring 42 can be rotated in a clockwise direction to a maximum clockwise position shown in FIG. 6. The connector-polarizing shell assembly 79–85 has been omitted from FIG. 6 for purposes of clarity. This clockwise rotation to a maximum clockwise position accomplishes several purposes. First of all, the male contact 80 will be locked with respect to the female contact 52 by virtue of the engagement of female contact pin 55 in the male contact slot 82, as taught in the above-noted U.S. Pat. No. Re. 25,506. The maximum clockwise rotative position of the female rotating ring 42 is determined by this engagement between the male contact 80 and the female contact 52.

It will be noted from FIG. 6 that when the female rotating ring 42 has achieved its maximum clockwise rotative position, its lug 75 no longer resides in the notch 62 of locking pin 41. As a result of this, the locking pin 41 is free to be shoved rearwardly (as viewed in FIG. 2) against the action of its own compression spring 66. This, in turn, means that once the ground connector has been fully mated and locked with its female receptacle, the cover 5 of the neutral receptacle can now be opened. The connector-polarizing shell assemblies and female rotating rings for each of the neutral and phase-one, phase-two and phase-three lines, operate in exactly the same manner. Thus, once the neutral cable connector has been fully mated and locked with respect to its receptacle, its locking pin will be released and cover 6 can be opened. When the connector for phase-one is fully mated and locked with respect to its receptacle, its locking pin will be released enabling cover 7 to be opened. Once the connector for phase-two has been fully mated and locked with respect to its receptacle, cover 8 can be opened for engagement of the phase-three connector with its respective receptacle. Thus, it will be apparent that the connectors for the ground line, neutral line and phase lines one, two and three can be connected with their respective receptacles only in that order.

Once cover 5 has been opened and the neutral line has been connected to its respective receptacle, the ground line contact cannot be disconnected from its female contact. The reason for this lies in the fact that once locking pin 41 has been released by connection of the ground line connector to its respective receptacle, the locking pin is free to be depressed and is depressed when cover 5 is opened. When the locking pin 41 is depressed against the action of its compression spring 66, its notches 62 and 63 are no longer in alignment with female rotating ring lug 75 and locking latch 43. Thus, as will be evident, if the locking pin notch 62 is no longer in alignment with female rotating ring lug 75, counterclockwise rotation of the female rotating ring is precluded by abutment of the lug 75 against locking pin 41. Without counterclockwise rotation, the male and female contacts 80 and 52 cannot be disconnected from each other and the connector-polarizing shell assembly 79–85 cannot be withdrawn from opening 3 in panel 1.

On the other hand, if the neutral line connector is disconnected from its respective receptacle and removed from panel 1 so that cover 5 will return to its closed position under the influence of its torsion spring (not shown), locking pin 41 will be free to assume its extended position shown in FIG. 2, under the influence of its compression spring 66. Under these circumstances, the notches 62 and 63 of locking pin 41 will be aligned with respect to female rotating ring lug 75 and locking latch 43. Therefore, the female rotating ring 60, together with the ground line connector 79 and its polarizing shell 85 can be rotated in a counterclockwise direction to the extent that male and female contacts 80 and 52 are no longer interlocked and the ground line connector can now be removed from panel 1.

It will be understood from the above description that each of the covers 5 through 8 will cooperate in the same manner with respect to the various locking pins 41. As a consequence, the connectors for lines 3, 2, 1, neutral and ground can only be disconnected from panel 1 in that order.

Referring to FIG. 1, it will be noted that there is no locking pin 41 visible to the right of the last or righthandmost cover 8. This is true because there is no additional cover for such a locking pin to lock. Nevertheless, the receptacle housing mounted behind cover 8 will be provided with a locking pin. Referring to FIG. 2, the locking pin 41 in the last receptacle housing behind cover 8 will be modified and glued into place without compression spring 66. The locking pin is so located that its notch 63 is in the position shown in FIG. 2. The locking pin is cut off substantially flush with the rear surface notch 62 for reasons to be described hereinafter. Although this righthandmost locking pin has no cover with which to cooperate, its presence is important because it enables the locking latch of the righthandmost receptacle housing to function in its normal manner, as described heretofore with respect to FIG. 2.

The fact that the locking latch functions in its normal manner assures that a connector without the proper polarizing shell cannot be used in this last position of the panel assembly. Thus, the last position of the panel assembly can only be occupied by the connector of the phase-three line, provided with the proper polarizing shell.

In the embodiment described, the receptacles are female receptacles and the cable connectors are male cable connectors. It will be understood by one skilled in the art that this can be reversed. In other words, all of the receptacles can be male receptacles and all of the cable connectors can be female cable connectors. This will require appropriate modification of the polarizing shells and the rotating rings as is fully described in the above-mentioned copending application. The operation of the panel assembly is otherwise the same as that just described. The applicants have chosen to describe and illustrate female receptacles and male cable connectors since, by convention, these are generally used if the panel is to serve as an output panel.

Since each of the covers 5, 6, 7 and 8 cannot be raised until the correct preceding connector is locked into position, by padlocking cover 4 as shown in FIG. 1, all of the covers are locked in closed position, when the panel is not in use. It will be understood that panels of the type just described provide a simplified system wherein the ground connector makes first and breaks last.

An exemplary panel provided with polarizing means and interlocking elements determining the order in which connectors can be connected and disconnected having been described, the teachings of the present invention can now be set forth. The present invention adds a third safety system to the polarizing system and interlocking element system just described. When the panel 1 is used as an output panel, it is of importance that there be no voltage applied to the receptacles of the panel during connection of the cable connectors to the panel receptacles and during disconnection of the cable connectors from the panel receptacles. A powered connection or disconnection can result in arcing which not only represents a safety hazard, but also can result in damage to the panel and the cable connectors, as well as damage to equipment to which the cables are connected. The present invention contemplates a simple and inexpensive safety system which precludes powered connections and disconnections.

Figures 7, 8:
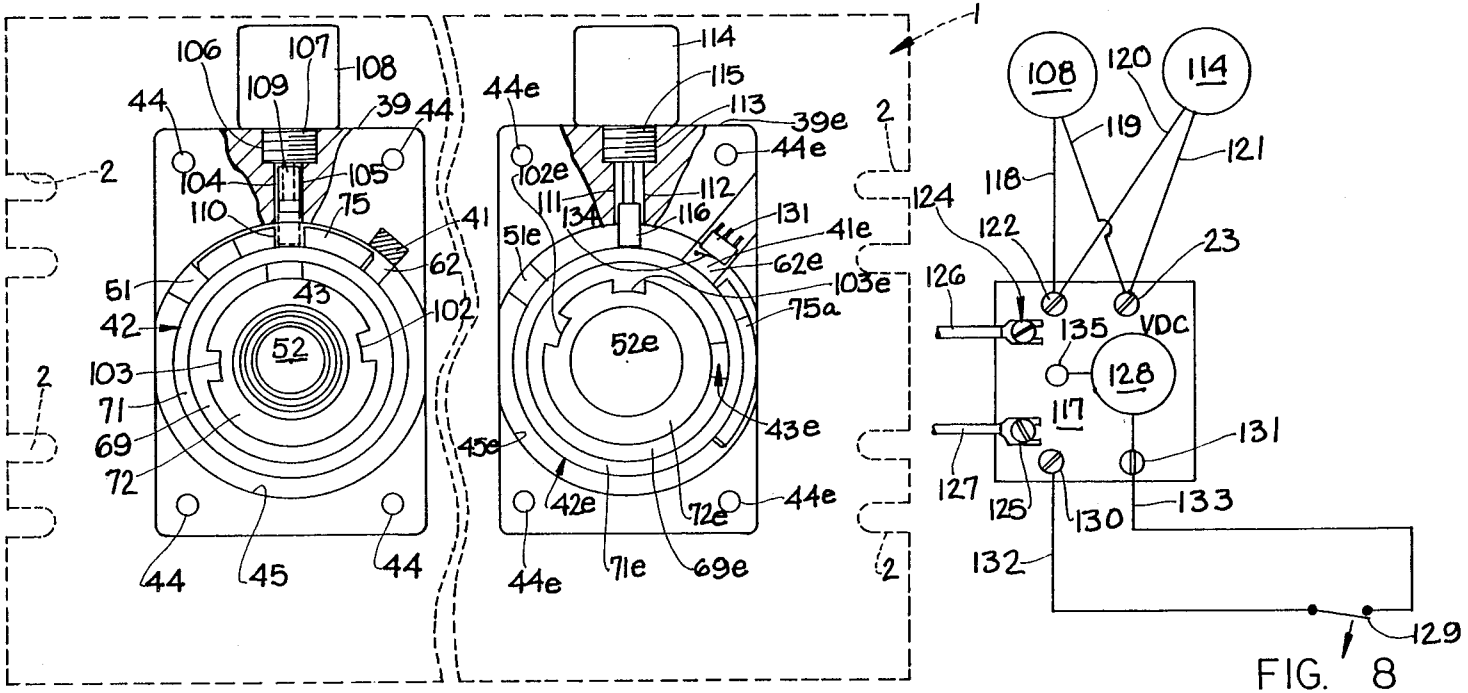
FIG. 7 is a fragmentary, simplified elevational view of the panel of FIG. 1, illustrating the first and last receptacle thereof, and further illustrating the present invention applied thereto.
FIG. 8 is a simplified electrical diagram present invention.

Reference is now made to FIG. 7. FIG. 7 is a simplified representation of the panel of FIG. 1. In FIG. 7, the panel 1 is shown in broken lines. FIG. 7 also illustrates the receptacle housings and their appertinences for the first receptacle and the last receptacle of the panel. Since the panel of FIG. 1 is a five receptacle panel, it will be assumed that the receptacles and receptacle housings illustrated in FIG. 7 are those to be found behind covers 4 and 8 of FIG. 1. Since the first or lefthandmost receptacle housing and its appertinences are for the ground receptacle, like parts have been given the same index numerals as are found in FIGS. 2, 5 and 6. Since, in FIG. 7, the righthand receptacle represents the righthandmost or last receptacle of the panel, always a power receptacle, and since the righthand receptacle and its appertinences are substantially identical, the same index numerals have been used, followed by "e". It will be understood by one skilled in the art that in a two-receptacle panel, the receptacle housing **39*e* would be found behind a cover equivalent to cover 5 of FIG. 1. Similarly, in three and four receptacle panels, the receptacle housing 39*e* would be found behind covers equivalent to covers 6 and 7**, respectively. Regardless of the number of receptacles with which the panel is provided, it should be remembered that the present invention is directed to the first or ground receptacle and the last receptacle which is always a power receptacle.

According to the invention, the first receptacle housing 39 for the ground receptacle 52 is provided with a bore 104 which extends from the exterior of receptacle housing 39 and intersects the housing bore 45 at the position of the arcuate lug 75 on female rotating ring 42, when the female rotating ring 42 is at its maximum counterclockwise rotative position. The bore 104 has a lower portion 105 and a larger diameter upper portion 106 which is threaded. The upper portion 106 is adapted to receive the threaded neck 107 of a first solenoid 108. The first solenoid 108 has an armature or plunger 109. While first solenoid 108 is shown mounted on receptacle housing 39 by a threaded engagement, other means could be used, as is well-known in the art. When the first solenoid 108 is not energized, its plunger 109 occupies the retracted position shown in solid lines in FIG. 7, wholly within portion 105 of bore 104. When the first solenoid 108 is energized, plunger 109 shifts to an extended position wherein it abuts or is adjacent to the peripheral surface of the female rotating ring outer wall 71, as is shown in broken lines in FIG. 7. The female rotating ring 42 is shown in FIG. 7 in its maximum counterclockwise position, normally occupied by the female rotating rings of the receptacles when cable connectors are not connected to panel 1. It will be noted in FIG. 7 that the arcuate lug 75 of female rotating ring 42 is provided with a notch 110 adapted to accommodate solenoid plunger 109 when the solenoid is actuated and its plunger is in its extended position.

The receptacle housing **39*e* and its appertinences are identical to receptacle housing 39 and its appertinences, with two exceptions. It will be remembered that locking pin 41*e* will be modified and glued in place. Further, the polarizing notches 102*e* and 103*e* of female rotating ring 42*e* occupy different positions as compared to polarizing notches 102 and 103 of female rotating ring 42**.

Receptacle housing **39*e* is provided with a bore 111, equivalent to bore 104, and having a lower portion 112 and a larger diameter upper portion 113 which is threaded. The receptacle housing 39*e* is provided with a second solenoid 114 having a threaded neck 115 engaged in receptacle housing bore portion 113. The second solenoid 114 is provided with a plunger 116, similar to plunger 109 of first solenoid 108. In FIG. 7, the female rotating ring 42*e* is shown in its maximum clockwise position, which it would occupy when a polarizing shell/connector assembly (not shown) is connected and locked to receptacle 52*e*. In FIG. 7, the plunger 116 of second solenoid 114 is shown in its extended position which it would occupy when solenoid 115 is energized. In its extended position, plunger 116 abuts or lies adjacent to the peripheral surface of the female rotating ring outer wall 71*e*. It will be understood that, when the second solenoid 114 is not energized, its plunger 116 will occupy a retracted position wholly within portion 112 of perforation 111, and similar to the position of plunger 19** shown in solid lines.

Reference is now made to FIG. 8 which is a simple electrical diagram of the present invention. In FIG. 8, the first solenoid 108 and the second solenoid 114 are shown. FIG. 8 also illustrates an AC to DC converter/-voltage regulator 117.

Panels of the type to which the present invention is directed are normally rated for use with AC or DC having a voltage range of from 120 volts to 600 volts. The converter/regulator 117 is capable of being connected to either AC or DC with a voltage rating of from 120 volts to 600 volts. At its outputs, the converter/-voltage regulator provides 12 volts DC and 115 volts DC. AC to DC converter/voltage regulators of this type are commercially available and are manufactured, for example, by the Wisecup Research Laboratories of Hamilton, Ohio. The converter/regulator can be mounted in any appropriate manner behind panel 1.

As shown in FIG. 8, the first and second solenoids 108 and 114 are connected by leads 118 and 119 and by leads 120 and 121, respectively, across the 115 volt outputs 122 and 123 of converter/regulator 117. The inputs 124 and 125 of converter/regulator 117 can be connected (see FIG. 1) by leads 126 and 127 to the neutral receptacle contact behind cover 5 and any one of the power receptacle contacts behind covers 6, 7 or 8. Alternatively, the inputs 124 and 125 could be connected to any two of the power receptacle contacts behind covers 6, 7 and 8. Where these contacts are connected to busbars, the leads 126 and 127 may be connected to those busbars.

The basic safety system of the present invention having been described, its operation may now be set forth. Turning to FIG. 7, let it first be assumed that there are no cable connectors connected to panel 1. Under these circumstances, the female rotating ring 42 of receptacle housing 39 will be in the position shown (i.e., its maximum counterclockwise position). The female rotating ring **42*e* of receptacle housing 39*e* would similarly be in its maximum counterclockwise position, with the arcuate lug 75*e* abutting stop 51*e*. If panel 1 has voltage applied to its receptacles, the converter/regulator 117 will sense the voltage and whether the power source is AC or DC. The converter/regulator will output 115 volts DC and the first solenoid 108 and the second solenoid 114 will be energized. Plunger 109 of the first solenoid 108 will be in its extended position within notch 110 in the arcuate lug 75 of female rotating ring 42. If an operator opens cover 4 and inserts the proper ground cable connector into the ground receptacle 52, the solenoid plunger 109 will preclude rotation of the connector and the female rotating ring 42. Thus, the ground cable connector will not lock with its respective ground receptacle 52 and, more importantly, since the female rotating ring 42 cannot rotate in a clockwise direction, locking pin 41 will not be released by arcuate lug 75 and the next cover 5 cannot be opened. Thus, cable connectors cannot be connected to the remaining positions when the panel 1 has voltage applied to its receptacles. Under these circumstances, the second solenoid 114 will also be energized. However, it serves no real purpose in preventing a powered connection and its plunger will simply abut the outer surface of the arcuate lug 75*e* of female rotating ring 42*e*. Once the operator realizes that panel 1 has voltage applied to its receptacles and that he cannot connect the cable connectors to their respective receptacles, he will then turn off the power source. As soon as this occurs, the converter/voltage regulator will no longer output 115 volt DC and the first solenoid 108 and the second solenoid 114 will no longer be energized. As a result of this, their respective plungers 109 and 116 will return to their retracted positions and the ground cable connector is now free to rotate with the female rotating ring 42 to its locked position. This will release cover 5 so that the neutral cable connector can be connected to its respective receptacle. Connection and locking of the neutral cable connector will release cover 6 for connection and locking of the phase-one cable connector to its respective receptacle. This in turn will release cover 7 enabling the second phase cable connector to be connected and locked to its respective receptacle. Finally, when the second phase cable connector is connected and locked, cover 8** will be released so that it may be opened and the phase three connector may be connected and locked to its respective receptacle.

With all of the cable connectors connected and locked to their respective receptacles, the panel 1 may now be connected to the power source. As soon as this is accomplished, it will be understood by one skilled in the art that the converter/regulator 117 will again energize first solenoid 108 and second solenoid 114. With all of the cable connectors connected and locked and the panel connected to power, the female rotating ring **42*e*, the second solenoid 114, and its plunger 116 will be in the positions shown in FIG. 7. It will be understood that the female rotating ring 42 of the ground receptacle housing 39 will be in its maximum clockwise position with its arcuate lug 75 rotated past locking pin 41. The plunger 109 of first solenoid 108 will simply abut or lie adjacent to the peripheral surface of the outer wall 71 of female rotating ring 42 just as is shown with respect to plunger 116 of the second solenoid 114 in FIG. 7**.

Should the operator decide to disconnect the cable connectors from panel 1 and should he neglect to turn off the power source, he will find upon attempting to disconnect the cable connector from the last receptacle **52*e* (as is required by the interlocking elements), that this cannot be done. The reason that the cable connector cannot be removed from the last receptacle of the panel, if the panel receptacles have voltage applied thereto, lies in the fact that the plunger 116 of second solenoid 114 precludes counterclockwise rotation of the cable connector and the female rotating ring 42*e* to the maximum counterclockwise position. This, in turn, means that the contact of the cable connector cannot be unlocked and disengaged from the contact of receptacle 52*e*. By virtue of the interlocking elements of panel 1, if the cable connector cannot be disconnected from the last receptacle of panel 1, then none of the other cable connectors can be disconnected from their respective receptacles. It will be understood that although the first solenoid 108** is also energized, it plays no real part in preventing a powered disconnection.

If, upon realizing that the cable connectors cannot be disconnected from panel 1 because panel 1 has voltage applied to its receptacles, the operator then shuts off the power source, first and second solenoids 108 and 114 will be de-energized and their plungers 109 and 116 will return to their retracted positions. Under these circumstances, the cable connector can be unlocked and disconnected from the last receptacle of panel 1 and the remaining cable connectors can be disconnected from the panel in their proper order, as dictated by the panel interlocking elements. The safety system thus far described is complete and foolproof to prevent powered connection. However, the safety system thus far described can be defeated with respect to powered disconnection if the operator, when connecting the appropriate cable connector to the last receptacle (the righthandmost receptacle) of panel 1 fails to rotate and lock the cable connector with respect to the last receptacle. Under these circumstances, the female rotating ring 42*e* will remain in its maximum counterclockwise position with arcuate lug 75*e* abutting stop 51*e*. As a consequence, when the power source is turned on and both solenoids 108 and 114 are energized, the plunger 116 of solenoid 114 will simply be shifted toward its extended position until it abuts the outer surface of arcuate lug 75*e*. Since the appropriate connector was never locked with respect to the last receptacle 52*e* and the female rotating ring 42*e* was not rotated to the position shown in FIG. 7, there is nothing to preclude disconnection of the cable connector from the last receptacle 52*e*, even though there is voltage applied to the panel receptacle. Once the cable connector is disconnected from the last receptacle 52*e*, cover 8 can achieve its closed position and the locking pin 41 located behind the locking lug 20 of cover 8 is free to achieve its normal extended position under the influence of its compression spring so that the next cable connector connected to its receptacle behind cover 7 can be disconnected, as can all of the remaining cable connectors in the order dictated by the interlocking elements of panel 1. As a consequence of this, in order for the safety system of the present invention to be foolproof with respect to a powered disconnection, the appropriate cable connector must not only be connected to the last receptacle 52*e*, but must be rotated and locked with respect thereto so that the rotating ring 42*e* achieves its maximum clockwise position as illustrated in FIG. 7 and plunger 116 of second solenoid 114 can assume its position illustrated in FIG. 7.

To assure that the appropriate cable connector is connected, rotated and locked with respect to the last receptacle 52*e*, the safety system of the present invention includes an alarm. Turning first to the diagram of FIG. 8, the alarm is shown at 128. The alarm 128 may be a visual alarm (such as a light or flashing light), an audible alarm (such as a buzzer, a bell, or the like), or both. Excellent results have been achieved utilizing an alarm 128 in the form of a piezo alarm.

The alarm 128 can be located on the convertor/-regulator 117 which provides a separate 12 volt DC power source for the alarm. A normally open limit switch 129 is connected to the alarm through terminals 130 and 131 by leads 132 and 133.

Reference is now made to FIG. 7. In FIG. 7, the normally open limit switch 129 is shown mounted to the forward end of the modified locking pin 41*e*. Limit switch 129 can be affixed to the locking pin 41*e* in any appropriate manner (not shown) such as by screws or other fastening means.

Limit switch 129 is so positioned that its actuator 134 extends slightly into the bore 45*e* of the receptacle housing 39*e*, when the actuator is in its open position. It will be apparent from FIG. 7 that when the arcuate lug 75*e* of the female rotating ring 42*e* is in its normal position with one of its ends abutting stop 51*e*, the other end of the arcuate lug 75*e* underlies switch 129, maintaining switch actuator 134 in its closed position.

When the appropriate cable connector is mated with receptacle 52*e* and rotated to its locked position, the female rotating ring 42*e* will rotate to its maximum clockwise position as illustrated in FIG. 7. When the female rotating ring is in its maximum clockwise position, its arcuate lug 75*e* has moved out from beneath switch 129, and the switch actuator 134 is free to return to its open position.

It is important to note that, during its clockwise rotation, the arcuate lug 75*e* of the female rotating ring 42*e* does not clear the area of limit switch 129 until well after it has cleared the area occupied by solenoid plunger 116 when in its extended position. This assures that the solenoid plunger 116 will be free to move into its extended position, if necessary, when the cable connector is mated with receptacle 52*e* and is rotated to its locked position, turning the female rotating ring 42*e* and its arcuate lug 75*e* to the position shown in FIG. 7.

The operation of alarm 128 is such that it is energized whenever the panel has voltage applied to its receptacles, unless the actuator 134 of normally open limit switch 129 is free and the normally open contacts of limit switch 129 are in the open position, by moving the arcuate lug 75*e* of the female rotating ring 42*e* clockwise far enough to clear the limit switch area. If the panel operator connects each of the cable connectors to its respective receptacle, in the order required by the interlocking elements of panel 1, but fails to rotate and lock the cable connector for the last or righthandmost receptacle 52*e* of panel 1, then, when the panel 1 receptacles have voltage applied thereto, alarm 128 will be actuated. This will remind the panel operator to rotate and lock the cable connector for the last receptacle, whereupon the alarm 128 will be deactivated. At the same time, however, the plunger 116 of second solenoid 114 will be free to shift to the position shown in FIG. 7 when voltage is applied to the receptacles of panel 1 and therefore can serve its purpose, the safety system of the present invention now being foolproof with respect to powered disconnection, as well as powered connection.

Modifications may be made in the invention without departing from the spirit of it. For example, the solenoids 108 and 114 are described as being operated by 115 volt DC. Solenoids operated by other DC voltages could be used. Similarly, the alarm 128 is described as being operated by 12 volt DC. Depending on the nature of the alarm (a light, a bell, a buzzer, etc.), other DC voltages could be used.

What is claimed is:

1. A safety system for an electrical output panel having at least two receptacles for use with cable connectors, said receptacles being mounted behind said panel in a side-by-side row, said panel having an opening therethrough for each receptacle and coaxial therewith through which a cable connector can extend for mating and locking with said receptacle, the receptacle at one end of said row comprising the first ground receptacle, the receptacle at the other end of said row comprising the last power receptacle, mechanical interlocking means in association with said panel determining the order in which the cable connectors are connected to and disconnected from their receptacles to assure that connectors must be connected to said receptacles in order from said first ground receptacle to said last power receptacle and must be disconnected from said receptacles in order from said last power receptacle to said first ground receptacle, said safety system comprising an AC to DC converter/voltage regulator having a pair of inputs and a first pair of outputs, said converter/-regulator being capable of converting 120 volts to 600 volts AC or DC at its inputs to 115 volts DC at said first outputs, said converter/regulator inputs being operatively connected to the contacts of a neutral and a power receptacle or any two power receptacles of said panel, first and second solenoids associated with said first and last receptacles respectively, each of said first and second solenoids being connected across said first converter/regulator outputs such as to be energized by said converter/regulator when a voltage is applied to said panel receptacles, each of said first and second solenoids having a plunger, said plunger of each solenoid being shiftable between a normally retracted position and an extended position when its solenoid is energized, said plunger of said first solenoid when in its extended position being positioned to preclude connection and locking of a cable connector with said first ground receptacle, said plunger of said second solenoid when in its extended position being positioned to preclude unlocking and disconnection of a cable connector from said last power receptacle, whereby said converter/regulator and first and second solenoids, in conjunction with said mechanical interlocking means, prevent connections of cable connectors to said panel receptacles and disconnections of cable connectors from said panel receptacles while a voltage is applied to said panel receptacles.

2. The safety system claimed in claim 1 including two receptacles mounted on said panel, said first receptacle comprising a ground/neutral receptacle and said last receptacle comprising a single phase AC or DC receptacle.

3. The safety system claimed in claim 1 including three receptacles mounted on said panel, said first receptacle comprising a ground receptacle, said second receptacle comprising a neutral receptacle, and said last receptacle comprising a single phase AC or DC receptacle.

4. The safety system claimed in claim 1 wherein said panel is a three phase AC panel having four receptacles mounted thereon, said first receptacle comprises a ground receptacle, said second receptacle comprises a phase-one power receptacle, said third receptacle comprises a phase-two power receptacle, and said last receptacle comprises a phase-three power receptacle.

5. The safety system claimed in claim 1 wherein said panel is a three phase AC panel having five receptacles mounted thereon, said first receptacle comprises a ground receptacle, said second receptacle comprises a neutral receptacle, said third receptacle comprises a phase-one power receptacle, said fourth receptacle comprises a phase-two power receptacle, and said last receptacle comprises a phase-three power receptacle.

6. The safety system claimed in claim 1 wherein said converter/regulator has a second pair of outputs, said converter/regulator converting said 120 volts to 600 volts AC or DC at its inputs to 12 volts DC at said second pair of outputs, an alarm means and a normally open switch being connected in series across said second pair of outputs, said interlocking means being configured to maintain said normally open switch closed and said alarm energized when a voltage is applied to said receptacles and a cable connector is not mated and locked to said last receptacle.

7. The safety system claimed in claim 1 including a cable connector for each of said receptacles, each of said connectors being insertable into said receptacle and rotatable by a partial clockwise turn to lock the contacts thereof together, a polarizing sleeve being mounted on each of said connectors, polarizing means being provided in association with each of said receptacles, said polarizing sleeves and said polarizing means being so configured that each polarizing sleeve will cooperate with only one of said polarizing means whereby each connector can be mated only with a predetermined one of said receptacles.

8. The safety system claimed in claim 7 wherein said panel has front and rear planar surfaces, a cover for each of said panel openings hingedly mounted on said front surface of said panel adjacent each opening therein, each cover being swingable between a closed and an open position, spring means biasing each cover to its closed position, each cover except the cover for said first panel opening having a laterally extending locking lug, a receptacle housing mounted on the rear surface of said panel behind each opening therein, each receptacle housing having a main bore coaxial with its respective panel opening, each receptacle being mounted on the rear surface of its respective receptacle housing with its forward end extending into and coaxial with said receptacle housing main bore, said interlocking means comprising a locking pin mounted in a bore formed in each receptacle housing and having an axis parallel to the axis of said main bore, said panel having a locking pin opening formed therein coaxial with each of said locking pin bores except for the last locking pin bore of the last receptacle housing for said last receptacle, each locking pin except the last one in said last receptacle housing having a forward nose portion, compression spring means in said locking pin bores except said last locking pin bore to urge said locking pins forwardly to a locking position wherein each of said nose portions of said locking pins extends through its respective locking pin opening in said panel and abuts said locking lug of said cap covering the panel opening for the next adjacent receptacle in a direction away from said first receptacle, each locking pin nose, when its respective locking pin is in its unlocking position, releasing its respective cover locking lug, said last locking pin being fixed in a forward position in said last locking pin bore, said polarizing means in association with said receptacles each comprising a ring rotatively mounted on said forward end of its respective receptacle within said main bore of its respective receptacle housing, each ring being coaxial with its respective receptacle housing main bore, the interior of each ring being configured to receive the forward portion of said polarizing shell of its respective connector only, each ring having an arcuate lug extending radially from its peripheral surface and partway thereabout, a latch for each ring slidably received in a peripheral slot in its respective ring, said slot in each ring extending partway across said ring in a direction parallel to the axis of said ring, each latch being shiftable in said slot in directions parallel to the axis of said ring between a forward latching position and a rearward unlatching position, a portion of said latch slot in each ring intersecting said ring interior, each locking pin having first and second transverse notches therein, each ring lug being receivable in said first notch when its respective locking pin is in its locking position, each latch being receivable in said second notch when its respective locking pin is in its locking position and said latch is in its unlatching position, each ring being rotatable between a maximum counterclockwise position determined by a stop formed in said main bore of its respective receptacle housing and a maximum clockwise position determined by said locking of said contacts of its respective connector and receptacle, said arcuate lug of each ring normally being located in said first locking pin notch maintaining its respective locking pin in its locking position, said arcuate lug of each ring being removed from said locking pin first notch when said ring is in said maximum clockwise position, each ring being precluded from rotation from said maximum counterclockwise position to said maximum clockwise position by abutment of its respective latch in its latching position against its respective locking pin in its locking position, each latch being shiftable to its unlatching position by said forward portion of its respective polarizing shell when its receptacle is mated with its respective connector and the polarizing shell thereof is received within said ring of said receptacle, whereby when said normally unlocked cover for said first receptacle is opened and the proper connector is mated with said first receptacle and said connector polarizing shell is received within said ring of said first receptacle, said latch is shifted to said unlatching position in alignment with said second locking pin notch by said polarizing shell, permitting said connector, its polarizing shell and said ring to be rotated clockwise to lock said connector and receptacle contacts and to remove said ring arcuate lug from said locking pin first notch thereby permitting opening of the cover of the next receptacle for mating with its respective connector, the mating of each receptacle with its respective connector thus unlocking the cover for the next succeeding receptacle until the last receptacle is mated with its respective connector, thereby assuring that the receptacles must be mated with their respective connectors in order from said first receptacle to said last receptacle, and whereby when the connector is disconnected from said last receptacle and the cover therefor is closed, the locking pin of the preceding receptacle housing is shifted to its locking position, locking the cover of said last receptacle and permitting counterclockwise rotation of the connector of preceding receptacle and disconnection therefrom such that the disconnection of each connector from its respective receptacle will permit disconnection of the preceding connector from its receptacle until the connector is disconnected from the first-receptacle, thereby assuring that the connectors must be disconnected from their respective receptacles in order from said last receptacle to said first receptacle.

9. The safety system claimed in claim 8 wherein said arcuate lug of said ring of said first ground receptacle has a notch formed therein, said notch being so positioned that said plunger of said first solenoid enters and engages said notch when said first solenoid is energized by a voltage applied to said panel receptacles and when said ring is in its counterclockwisemost position, whereby said first solenoid plunger precludes clockwise rotation of said polarizing ring and thus mating and locking of its respective cable connector in said first ground receptacle and as a result further precludes mating and locking of all cable connectors with their respective receptacles of said panel while a voltage is applied to said panel receptacles.

10. The safety system claimed in claim 9 wherein said plunger of said second solenoid is located between said arcuate lug of said ring of said last receptacle and said stop therefor when said second solenoid is energized by a voltage applied to said panel receptacles and said ring is in its clockwisemost position, whereby said second solenoid plunger precludes counterclockwise rotation of said ring of said last receptacle and thus unlocking and disconnection of it respective cable connector from said last receptacle and as a result further precludes unlocking and disconnection of all cable connectors with their respective receptacles of said panel while a voltage is applied to said panel receptacles.

11. The safety system claimed in claim 10 wherein said converter/regulator has a second pair of outputs, said converter/regulator converting said 120 volts to 600 volts AC or DC at its inputs to 12 volts DC at said second pair of outputs, an alarm means and a normally open switch being connected in series with said second pair of outputs, said normally open switch having an actuator, said switch being so located in association with said receptacle housing of said last receptacle that said arcuate lug of said polarizing ring of said last receptacle engages said actuator and maintains it in its switch-closed position unless said ring is in its clockwisemost position, whereby said alarm will be energized whenever there is a voltage applied to said panel receptacles and said cable connector for said last receptacle is not in its mated and locked position.

12. A safety system for an electrical output panel having at least two receptacles and cable connectors therefor, said safety system comprising means responsive to a voltage applied to said panel receptacles to prevent connection and locking of said cable connectors to said panel receptacles and unlocking and disconnection of said cable connectors from said panel receptacles while a voltage is applied to said panel receptacles.

* * * * *